United States Patent [19]

Vogt

[11] Patent Number: 4,600,349

[45] Date of Patent: Jul. 15, 1986

[54] APPARATUS FOR TRANSPORTING AND POSITIONING SHEET METAL PLATES

[75] Inventor: Adolf Vogt, Günzburg, Fed. Rep. of Germany

[73] Assignee: Karl Mengele & Söhne, Günzburg/Donau, Fed. Rep. of Germany

[21] Appl. No.: 701,420

[22] Filed: Feb. 14, 1985

[30] Foreign Application Priority Data

Feb. 15, 1984 [DE] Fed. Rep. of Germany ..... 3405322

[51] Int. Cl.[4] ..... B65H 1/00

[52] U.S. Cl. ..... 414/225; 414/752; 414/606; 414/121; 414/122; 271/18.1; 294/2

[58] Field of Search ..... 414/225, 752, 606, 121, 414/122, 72, 74, 744 B, 744 C; 294/64.1, 65.5, 2; 271/18.1

[56] References Cited

U.S. PATENT DOCUMENTS

| | | | |
|---|---|---|---|
| 3,117,815 | 1/1964 | Creskoff | 294/64.1 |
| 3,159,418 | 12/1964 | Hansen | 294/64.1 X |
| 3,910,621 | 10/1975 | Hillier | 294/64.1 |
| 4,121,865 | 10/1978 | Littwin, Sr. | 294/2 |
| 4,361,062 | 11/1982 | Reiff | 414/121 X |

FOREIGN PATENT DOCUMENTS

| | | | |
|---|---|---|---|
| 2439032 | 2/1976 | Fed. Rep. of Germany | 414/752 |

OTHER PUBLICATIONS

Noble Company, "Automatic Plate and Sheet Handling Systems", Technical Brochure No. B-500, 1957.

*Primary Examiner*—Robert J. Spar
*Assistant Examiner*—D. Glenn Dayoan
*Attorney, Agent, or Firm*—Toren, McGeady, Stanger, Goldberg & Kiel

[57] ABSTRACT

Apparatus for transporting sheet metal plates from a supply source and positioning the plates at a plate shearing table includes a carrier capable of horizontal transport. A device is secured to the carrier for effecting up and down and turning movement. A gripper member is mounted on the device and moves with it. The gripper member includes at least one electromagnetic plate with an annular sealing lip in the surface of the plate. In combination with the surface of the plate, the sealing lip forms a suction space connected to vacuum producing equipment. A switch controls the electromagnetic plate and a control valve operates the vacuum producing equipment with the switch and control valve arranged in a parallel switching network.

5 Claims, 4 Drawing Figures

Fig. 1
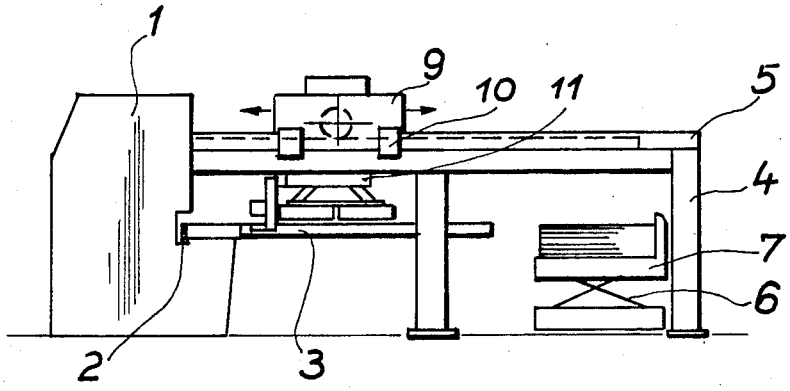
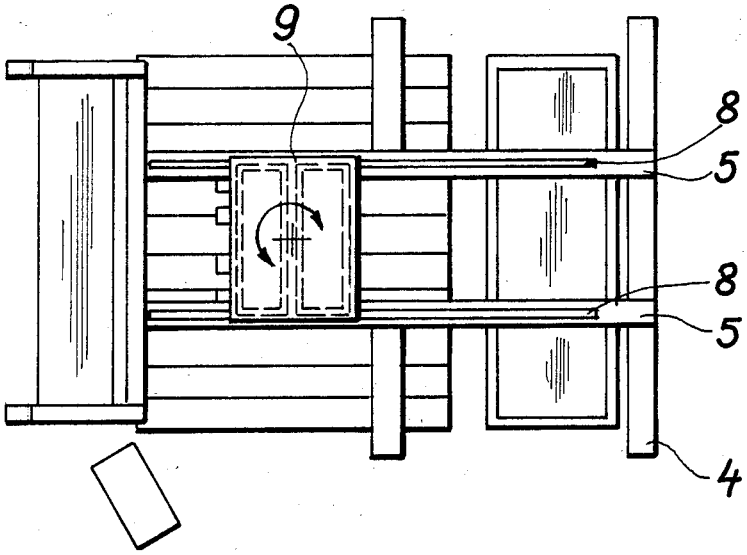
Fig. 2

APPARATUS FOR TRANSPORTING AND POSITIONING SHEET METAL PLATES

BACKGROUND OF THE INVENTION

The present invention is directed to an apparatus for transporting sheet metal plates to a shearing table or machine with the apparatus including a carrier movable to and from the shearing table and a device mounted on the carrier for turning movement and movement in the up and down direction.

There is a known apparatus of this type for use with a shearing machine for the trimming and production of true-to-size blanks, note German Offenlegungsschrift No. 30 10 062. For transporting and delivering the sheet metal plates at least a vacuum or suction apparatus is used. Primarily when sheet metal plates are being turned, because the surface of the plates is dirty, cracked or oily, it may happen that the plates are displaced relative to a previous position and not properly located at the shearing machine whereby the blanks cut from the plates do not have the desired dimensions.

SUMMARY OF THE INVENTION

The primary object of the present invention is to provide a gripper plate which holds the sheet metal plates in a secure manner so that they can be properly positioned at the shearing machine.

In accordance with the present invention, the gripper member includes at least one electromagnetic plate with a sealing lip provided in the surface of the electromagnetic plate facing the plate or workpiece to be gripped. The sealing lip is located within an annular retaining groove and projects outwardly from the surface of the electromagnetic plate so that the combination of the surface of the plate and the sealing lip provide a suction space connected with vacuum producing equipment through a bore in the electromagnetic plate and, if required, also through other tubes.

Utilizing the apparatus of the present invention, it is possible to grip sheet metal plates, such as plates being delivered to a shearing machine, so that the plates are held securely in a fixed position and the plates can not be displaced whereby the various movements of the plates can be carried out faster and the cutting operations on the plates can proceed more rapidly. In accordance with the present invention, utilizing CNC-programming, blanks can be produced from sheet metal plates in a simple manner with the highest possible accuracy. Further, thin sheet metal plates which can not be held safely by electromagnets, due to their small mass, can be handled in an improved way by the combined retention features of the present invention. It should be noted that the apparatus is also capable of handling non-magnetic sheet metal plates using the same gripping member.

It is possible to subdivide the suction space formed by the plate surface and the sealing lip by using additional sealing lips extending transversely of the sealing lips extending around the edge region of the electromagnetic plate.

A switch for operating the electromagnetic plate along with a magnetic control valve for the vacuum producing equipment can be operated together, for example, using a parallel switching network.

The various features of novelty which characterize the invention are pointed out with particularity in the claims annexed to and forming a part of this disclosure.

For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is a side elevational view of a sheet metal plate shearing machine embodying the present invention;

FIG. 2 is a top view of the machine shown in FIG. 1;

DETAILED DESCRIPTION OF THE INVENTION

Figure 3:
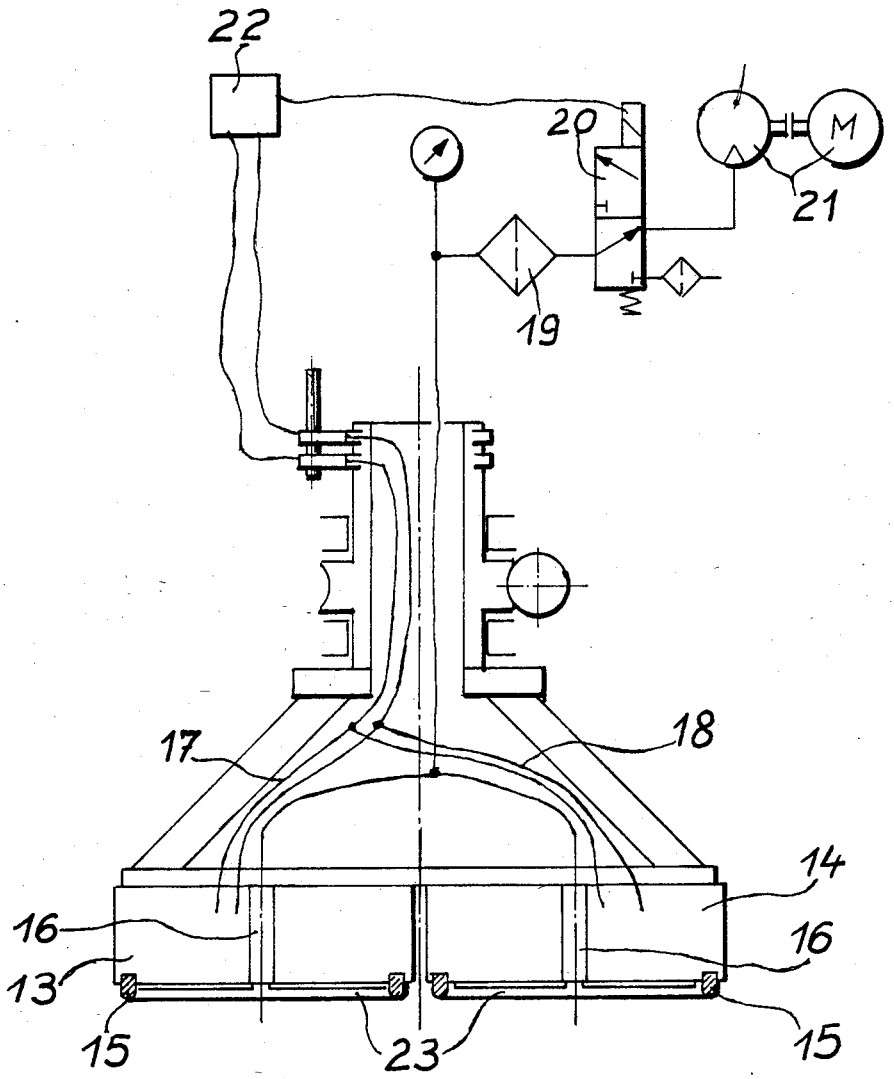
FIG. 3 is an enlarged view, partly in section, of a portion of the apparatus shown in FIG. 1.

In FIGS. 1 and 2 a hydraulic shearing machine is shown including a shearing table with the table being extended by a support 3. Spaced outwardly from the shearing machine 1 is a front bridge or support 4 with rails 5 resting on the upper end of the bridge 4 and extending to the shearing machine 1. The rails 5 are located above the shearing table 2 and the support 3. Adjacent the bridge 4 and below the rails 5 there is a plate support 7 movable in the vertical direction by an elevating link 6. As can be seen in FIG. 2, the laterally spaced rails 5 have sliding rods 8 extending in the long direction of the rails and a carrier 9 is movably supported on the sliding rods by means of bearings 10. The carrier is powered for movement along the rails, however, the means for moving the carrier is not significant to the present invention.

A gripper member 11 is mounted on the carrier 9 so that it can be moved upwardly and downwardly. Further, the carrier can also be turned about a central vertical axis, note the arrows shown in FIG. 2 indicating the direction in which the gripper member can be turned, the means for turning the gripper member are not illustrated. The control for the movement of the carrier along the rails 5 and for turning the gripping member around its central axis is effected by a rotary transmitter.

Figure 4:
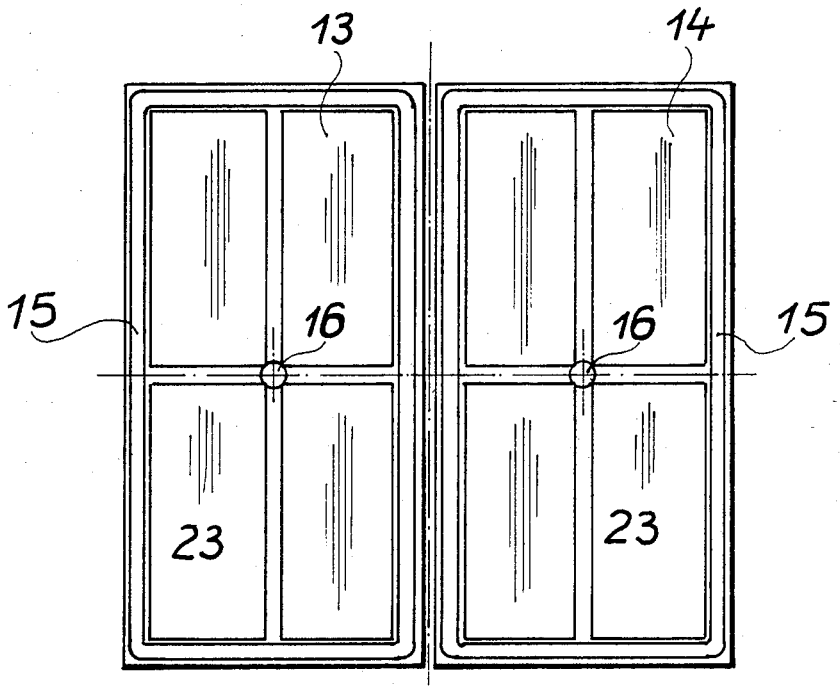
FIG. 4 is a detail view of a portion of the apparatus shown in FIG. 1.

In FIGS. 3 and 4, one embodiment of the gripping member according to the invention is illustrated. As indicated in FIGS. 3 and 4 two rectangularly shaped electromagnetic plates 13, 14 are arranged on the lower side of the gripping member 11. The electromagnetic plates 13, 14 each have an annular edge bounding the downwardly facing surface of the plate. Spaced closely inwardly from the boundary edge is an annular, rectangularly shaped in FIG. 4, sealing lip 15 projecting downwardly from the surface of the plate with the lip being held within a retaining groove formed in the plate surface. A bore 16 is located centrally in each of the electromagnetic plates 13,14 extending between the upper and lower surfaces of the plate so that the bore opens centrally into the space defined by the surface of the plate 13,14 and the annular sealing lip 15. As indicated in FIG. 3, each bore 16 is connected via tubes 17,18 through a filter 19 and a control valve 20 with a vacuum pump 21. A switch 22 is provided for admitting current to the electromagnetic plates 13, 14. The control valve 20 and the switch 22 are interconnected by a parallel switching network so that they can be operated together.

If the gripping member 11 along with the electromagnetic plates 13, 14 is placed on a ferromagnetic sheet metal plate mounted on the support 7 with the control valve 20 and the switch 22 being actuated, the electromagnetic plates 13 and 14 and the vacuum pump 21 are energized and the sheet metal plates are tightly held by the electromagnetic magnets and by the suction force developed within the suction space 23 defined by the downwardly facing surfaces of the plates 13, 14 and the annular sealing lip 15. The plates can be lifted from the support 7 and moved along the rails 5 into position on the shearing table 2. Since the plate is secured by the electromagnetic plates and by the suction action, the plate to be cut can be accurately positioned on the shearing table so that the resultant blank is cut to the proper size.

As is shown in FIG. 4, the suction space formed on the lower surface of the electromagnetic plates 13, 14 can be subdivided into smaller suction spaces by providing additional sealing lips arranged perpendicularly to one another and extending between mid-point locations on opposite sides of the annular sealing ring 15 encircling the suction space. As indicated somewhat schematically in FIG. 3, additional connections can be provided to the subdivisions of the suction space for connecting such subdivisions with the vacuum producing equipment.

While specific embodiments of the invention have been shown and described in detail to illustrate the application of the inventive principles, it will be understood that the invention may be embodied otherwise without departing from such principles.

I claim:

1. Apparatus for transporting and positioning sheet metal plates and the like at a sheet metal plate shearing machine including a shearing table, comprising a carrier for movably supporting the plate for movement to and from the shearing machine, a device mounted on said carrier for effecting upward and downward movement and turning movement relative to the shearing table, a gripping member secured to said device for movement therewith, said gripping member including at least one electromagnetic plate having a planar surface arranged to face the plate to be transported, said planar surface having an annular boundary edge defining the outer boundary of said surface, an annular groove formed in said planar surface adjacent to and spaced inwardly from said annular edge, an annular sealing lip positioned within and extending around said annular groove, said sealing lip protrudes outwardly from said planar surface and forms with said surface located within said sealing lip a suction space, a bore extending through said plate and opening through said planar surface to said suction space, vacuum producing equipment connected through said bore to said suction space, a switch for operating said electromagnetic plates, a control valve for operating said vacuum producing means and means for actuating said switch and control valve together.

2. Apparatus, as set forth in claim 1, wherein additional sealing lips extend across said planar surface between opposite edges of said electromagnetic plate for subdividing the suction space into subspaces.

3. Apparatus, as set forth in claim 2, including means connecting said vacuum producing means with said subspaces.

4. Apparatus, as set forth in claim 1, wherein said vacuum producing means comprises a connecting line in communication with said suction space, a vacuum pump connected to said connecting line, a filter disposed in said connecting line between said vacuum pump and said suction space, and a control valve located in said connecting line between said filter and said vacuum pump.

5. Apparatus, as set forth in claim 1, wherein said planar surface of said at least one electromagnetic plate is rectangularly shaped.

* * * * *